United States Patent [19]

Fischer

[11] Patent Number: 4,541,560

[45] Date of Patent: Sep. 17, 1985

[54] PARTITIONED BOX

[75] Inventor: David Fischer, Downsview, Canada

[73] Assignee: Domtar Inc, Montreal, Canada

[21] Appl. No.: 570,605

[22] Filed: Jan. 13, 1984

[51] Int. Cl.[4] ..... B65D 5/48

[52] U.S. Cl. ..... 229/27; 229/15; 229/29 D

[58] Field of Search ..... 229/15, 27, 28 R, 29 D, 229/42; 206/193, 194, 196, 197

[56] References Cited

U.S. PATENT DOCUMENTS

| | | | |
|---|---|---|---|
| 3,189,244 | 6/1965 | Whalen | 229/42 |
| 3,825,174 | 7/1974 | Booth, Jr. | 229/28 R |
| 3,977,592 | 8/1976 | Gorham | 229/28 R |
| 4,108,348 | 8/1978 | Partain | 229/15 |
| 4,376,508 | 3/1983 | Gardner et al. | 229/28 R |
| 4,482,055 | 11/1984 | Boyle | 229/28 R X |

FOREIGN PATENT DOCUMENTS

| | | |
|---|---|---|
| 556759 | 4/1958 | Canada . |
| 640747 | 5/1962 | Canada . |
| 665704 | 6/1963 | Canada . |
| 672213 | 10/1963 | Canada . |
| 684313 | 4/1964 | Canada . |
| 803860 | 1/1969 | Canada . |

*Primary Examiner*—Allan N. Shoap
*Assistant Examiner*—Bryon Gehman
*Attorney, Agent, or Firm*—Antoine H. Gauvin

[57] ABSTRACT

The carton is formed with a transverse partition formed by a first partition panel foldably connected to a glue panel of the box and having a second partition panel foldably connected thereto along the fold line substantially perpendicular to the fold line connection between the first partition panel and the glue panel. The second partition panel had a glue flap at its opposite end which is connected to its adjacent end wall of the carton. A transverse partition is formed in each of the first and second partition panels with the transverse partition panel formed from the first partition being at the end of the first partition remote from the said glue panel and the transverse partition in the second partition panel being formed adjacent the said glue panel. The transverse partitions are connected to their respective partition panels via fold lines substantially parallel to the fold line connection between the first partition panel and the glue panel. Preferably a glue tab will be formed in said second partition panel and will extend towards said glue panel from the fold line connection of the transverse partition of the second partition panel to the second partition panel.

13 Claims, 2 Drawing Figures

PARTITIONED BOX

FIELD OF THE INVENTION

The present invention relates to a box. More specifically the present invention relates to a partition box having a longitudinal partition formed by a pair of partition panels foldably connected by a longitudinally extending fold line and each having formed therein, one transverse partition which is foldably connected to its respective partition panel.

BACKGROUND OF THE INVENTION

There have been many proposals for the manufacture of partition boxes wherein box blanks are formed with an integral partition panel having transverse partitions cut therefrom. Generally, such partition boxes are formed with longitudinal partitions foldably connected at one end to the box and the other end to the glue flap that is adhered to the remote wall of the box. In many cases there are a pair of such partition panels each extending longitudinally of the box and generally both partition panels are in some manner connected to the remote end of the box. Attention is directed, for example, to Canadian Pat. No. 556,759 issued Apr. 29, 1958 to Richardson, and to Canadian Pat. Nos. 640,747, 665,704, 684,313 issued respectively on May 1st, 1962, June 25, 1963 and Apr. 14, 1964 to Gioia. Also of interest are Canadian Pat. Nos. 672,213, 803,860 issued Oct. 15, 1963 and Jan. 14, 1969 respectively to Lemon.

BRIEF DESCRIPTION OF THE INVENTION

It is the object of the present invention to provide a simplified carton structure, particularly suited for packing of beer bottles, generally in a 24-pack i.e. 4×6 although it can easily be adapted to a 2×6 or similar configuration.

Broadly the present invention relates to a carton blank and carton formed therefrom composed of first end wall, first side wall, second end wall, second side wall, a glue panel and a partition panel foldably interconnected via a set of substantially parallel fold lines. A second partition panel is foldably connected to said first partition panel via a connecting fold line substantially perpendicular to said set of fold lines. A first glue flap is foldably connected to the end of said second partition panel remote from said glued panel via a first fold line substantially parallel to said set of fold lines. A first transverse partition panel is formed in said first partition panel via line of severance spaced from said connecting fold line and connected at its end adjacent said glue panel to said first partition panel via a second fold line substantially parallel to said set of fold lines and having a second glue flap connected to its end remote from said glued panel via a third fold line substantially parallel to said set of fold lines. A second transverse partition panel is formed in said second partition panel via a line of severance and is connected at its end adjacent said first glue flap to the second partition via a fourth fold line substantially parallel to said set of fold lines and has a third glue flap foldably connected to its end remote from said first glue flap via a fifth fold line substantially parallel to said set of fold lines.

Preferably said fourth fold line does not extend to the free edge of the second partition panel and is connected to said free edge via a line of severance extending away from said first glue flap and towards said free edge to define a glue tab that may be secured to said first partition panel.

BRIEF DESCRIPTION OF THE DRAWINGS

Further features, objects and advantages will be evident from the following detailed description of the preferred embodiments of the present invention taken in conjunction with the accompanying drawings, in which.

DESCRIPTION OF THE PREFERRED EMBODIMENT

Figure 1:
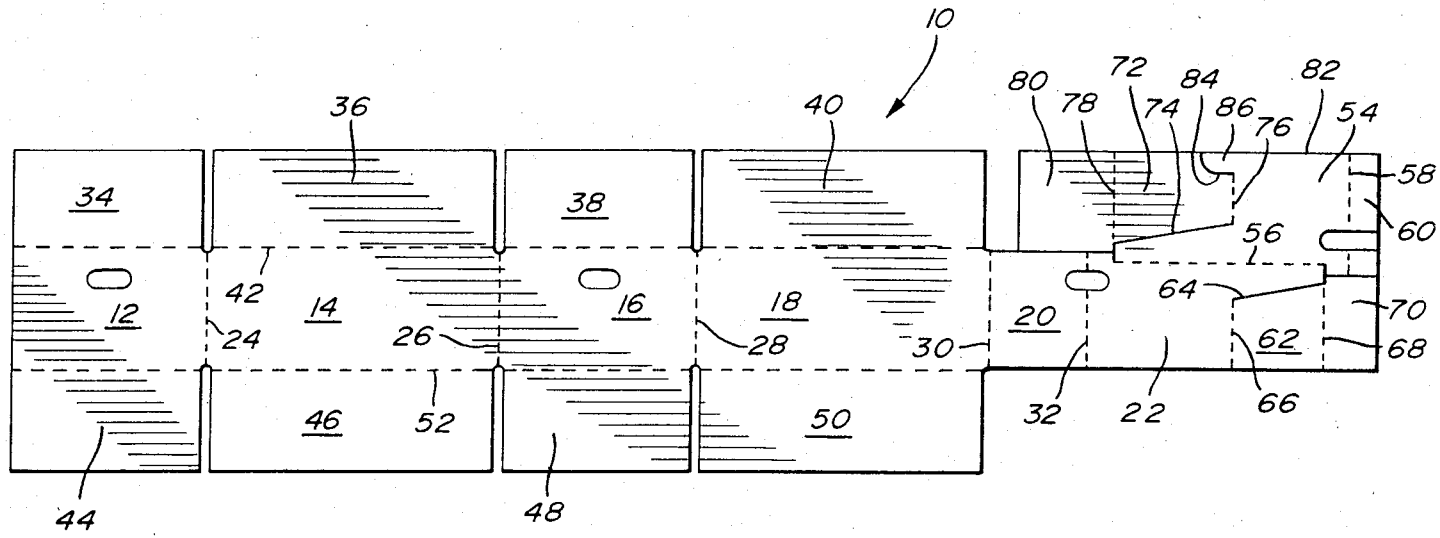
FIG. 1 is a plan view of a blank formed in accordance with the present invention.

The blank 10 of FIG. 1 is composed of a first end wall 12, first side wall 14, second end wall 16, second side wall 18, glue panel 20 and first longitudinal partition panel 22, foldably interconnected by a set of substantially parallel fold lines 24, 26, 28, 30 and 32. Top closure flaps 34, 36, 38 and 40 are connected to the top ends of the wall 12, 14, 16 and 18 respectively via fold line 42 and bottom closure flaps 44, 46, 48 and 50 are foldably connected to the bottom ends of wall 12, 14, 16 and 18 via fold line 52. The fold lines 42 and 52 are substantially perpendicular to the fold lines 24, 26, 28, 30 and 32.

A second longitudinal partition panel 54 is connected to the top edge of the partition panel 22 via a connecting fold line 56 substantially perpendicular to said set of fold lines. The second partition panel 54 has connected to its free end via a first fold line 58 substantially parallel to said pair of fold lines, a glue flap 60.

A first transverse partition 62 is formed in the first longitudinal partition panel 22 via a line of severance 64 and is connected at its end closest to glue panel 20 to the partition panel 22 via a second fold line 66 substantially parallel to the set of fold lines and has connected to its end remote from the glue panel 20 via third fold line 68 substantially parallel to the set of fold lines, a glue flap 70.

The second longitudinal partition panel 54 has a second transverse partition panel 72 similar to the first partition panel 62 formed therein by a severance line of 74 and is connected at its end closest the first glue flap 60 to the partition panel 54 via a fourth fold line 76 substantially parallel to the set of fold lines and has connected to its end remote from glue flap 60 via a fifth fold line 78 substantially parallel to said set of fold lines, a third glue flap 80.

The fold line 76 does not extend to the free edge 82 of the second longitudinal partition 54 but is connected thereto via a line of severance 84 that projects in a direction away from the first glue flap 60 and then curves to meet the free edge 82, thereby to provide a projection 86 extending to the side of the fold line 76 remote from the glue flap 60.

It will be noted in the illustrated arrangement that the fold line 56 is not aligned with the fold line 42 but is spaced slightly towards the fold line 52 so that the top edge of the partition formed by folding of the partition panel 54 into face-to-face relationship with panel 22 terminates slightly below the top of the box. This permits the height of the partition panels 22 and 54 to be made substantially equal without the free edge 82 projecting beyond the free edges of flaps 34, 36, 38 and 40 i.e. so that the material necessary to make the partition does not extend outwardly of the basic blank forming the periphery of the box end closure flaps.

Figure 2:
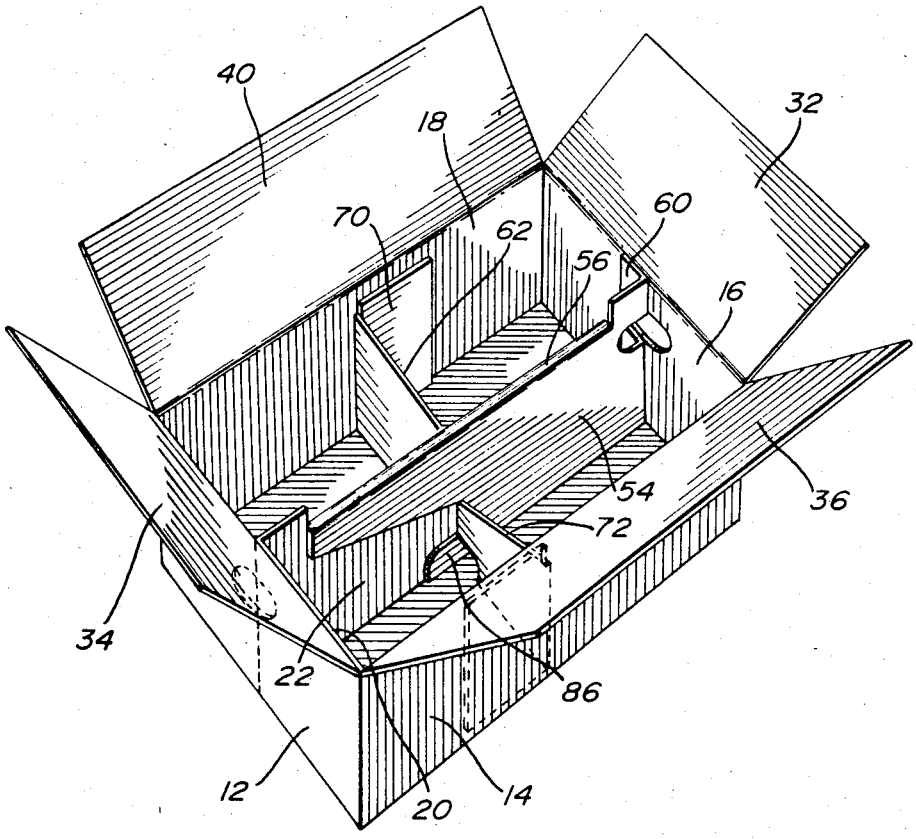
FIG. 2 is an isometric view looking down from the top of an open carton constructed from the blank of FIG. 1.

To construct the box, glue is applied at the appropriate locations on the blank and then the panel 54 is folded on fold line 56 into face-to-face relationship with panel 22 by folding on fold line 56. Next the two partition panels 22 and 54 and panel 20 are folded along the line 30 to lay the flap 60 onto the end wall 16, to be secured thereto by adhesive. Next the panels 14 and 12 are folded along the line 26 to move the panel 14 into overlying relationship with the glued flap 70 and to position the end wall 12 in overlying relation with the glue panel 20 to secure the box together. Obviously, the flaps 60, 70 and 80 will be secured via adhesive to their adjacent panels, similarly the projection 86 may be secured to the panel 22 to provide a significantly reinforced longitudinal partition structure and the panel 12 is secured to the glue panel 20 to form a knocked-down container which may be erected into the form shown in FIG. 2 by simply squaring the box and folding and securing the bottom flaps in the conventional manner.

It will be noted that in the preferred arrangement, the longitudinal partitions 22 and 54 are positioned substantially midway between the side walls 14 and 18 and the transverse partition 62 and 72 are located midway between the end walls 12 and 16.

Having described the present invention, modifications will be evident to those skilled in the art without departing from the spirit of the invention as defined in the appended claims.

I claim:

1. A blank comprising a first end wall, a first side wall, a second end wall, a second side wall, an end glue panel and a first partition panel foldably connected by a set of substantially parallel fold lines, a second partition panel foldably connected to said first partition panel via a connecting fold line substantially perpendicular to said set of fold lines, a first glue flap connected to the end of said second partition panel remote from said end glue panel by a first fold line substantially parallel to said set of fold lines, a first transverse partition formed in said first partition panel via a line of severance spaced from said connecting fold line, said first transverse partition connected at an end thereof closest said end glue panel to said first partition panel via a second fold line substantially parallel to said set of fold lines, a second glue flap foldably connected to the end of said first transverse partition remote from said end glue panel via a third fold line substantially parallel to said set of fold lines, a second transverse partition formed in said second partition panel via a line of severance spaced from said connecting fold line and connected to said second partition panel at the end of said second transverse partition closest to said first glue flap via a fourth fold line substantially parallel to said set of fold lines, a third glue flap connected to the end of said second transverse partition remote from said first glue flap via a fifth fold line substantially parallel to said set of fold lines.

2. A blank as defined in claim 1 wherein said fourth fold line substantially parallel to said set of fold lines terminates short of a free edge of said second partition panel and is connected to said free edge via a line of severance extending in a direction away from said first glue flap and terminating at said free edge to define a glue tab projecting in the plane of said second partition panel at the side of said fourth fold line substantially parallel to said set of fold lines remote from said first glue flap.

3. A blank as defined in claim 2 further comprising a set of top closure flaps connected one to the top end of each of said walls via a fold line substantially perpendicular to said set of fold lines, said top closure flaps each terminating in a free edge and said free edge of said second partition panel being substantially parallel to said free edge of said top closure panel and being spaced from said fold line substantially perpendicular to said set of fold lines measured in a direction parallel to said set of fold lines by a distance no greater than the spacing between said fold line substantially perpendicular to said set of fold lines and said free edges of said top closure flaps.

4. A blank as defined in claim 3 wherein said connecting fold line is spaced from said fold line substantially perpendicular to said set of fold lines and is on the opposite side of said fold line substantially perpendicular to said set of fold lines to said free edge of said second partition panel.

5. A blank as defined in claim 3 wherein said second and fourth fold lines substantially parallel to said set of fold lines are aligned and located spaced from said end glue panel by a distance equal to half the length of said side wall panels.

6. A blank as defined in claim 2 wherein said second and fourth fold lines substantially parallel to said set of fold lines are aligned and located spaced from said end glue panel by a distance equal to half the length of said side wall panels.

7. A blank as defined in claim 1 wherein said second and fourth fold lines substantially parallel to said set of fold lines are aligned and located spaced from said end glue panel by a distance equal to half the length of said side wall panels.

8. A carton comprising a first end wall, a first side wall, a second end wall, a second side wall and an end glue panel secured in face-to-face relationship with said first end wall, a first longitudinal partition panel foldably connected to said end glue panel and extending longitudinally of said carton spaced from said side walls, a first transverse partition formed from said first longitudinal partition panel at the end of said first longitudinal partition panel remote from said end glue panel with one end of said first transverse partition being foldably connected to said first longitudinal partition panel and an opposite end secured to one of said first and second side walls with a glue flap, a second longitudinal partition panel folded into face-to-face relationship to said first longitudial partition panel via a connecting fold line extending longitudinally of said box, a glue flap at the end of said second longitudinal partition panel remote from said end glue panel, said glue flap being secured in face-to-face relationship with said second end wall, a second transverse partition formed from said second longitudinal partition panel and connected at one end of said second longitudinal partition panel via a fold line and connected at its opposite end to the other of said first and second side walls via a glue flap.

9. A carton as defined in claim 8 further comprising a projection extending in the plane of said second longitudinal partition panel towards said end glue panel and secured in face-to-face relationship with said first longitudinal partition panel.

10. A carton as defined in claim 9 wherein said longitudinal partitions are spaced substantially midway between said side walls and wherein said transverse partition is spaced substantially midway between said end walls.

11. A carton as defined in claim 9 wherein said connecting fold line is spaced below the top of the box.

12. A carton as defined in claim 11 wherein said longitudinal partitions are spaced substantially midway between said side walls and wherein said transverse partition is spaced substantially midway between said end walls.

13. A carton as defined in claim 8 wherein said longitudinal partitions are spaced substantially midway between said side walls and wherein said transverse partition is spaced substantially midway between said end walls.

* * * * *